US006118960A

United States Patent [19]

Nakagawa et al.

[11] Patent Number: 6,118,960

[45] Date of Patent: Sep. 12, 2000

[54] END COVER, PROCESS CARTRIDGE AND ASSEMBLING METHOD FOR PROCESS CARTRIDGE

[75] Inventors: Takao Nakagawa, Numazu; Kazushi Watanabe, Mishima; Atsushi Numagami, Hadano; Katsunori Yokoyama, Susono, all of Japan

[73] Assignee: Canon Kabushiki Kaisha, Tokyo, Japan

[21] Appl. No.: 09/163,335

[22] Filed: Sep. 30, 1998

[30] Foreign Application Priority Data

Oct. 1, 1997 [JP] Japan ..... 9-284596

[51] Int. Cl.[7] ..... G03G 21/16

[52] U.S. Cl. ..... 399/111

[58] Field of Search ..... 399/110, 111, 399/107, 113, 119, 120, 114; 74/412 R, 421 R, 640, 665 F, 665 L, 665 GA, 665 GD

[56] References Cited

U.S. PATENT DOCUMENTS

| | | | |
|---|---|---|---|
| 4,551,000 | 11/1985 | Kanemitsu, et al. | 355/3 R |
| 5,095,335 | 3/1992 | Watanabe et al. . | |
| 5,151,734 | 9/1992 | Tsuda et al. . | |
| 5,208,634 | 5/1993 | Ikemoto et al. . | |
| 5,223,893 | 6/1993 | Ikemoto et al. . | |
| 5,294,960 | 3/1994 | Nomura et al. . | |
| 5,331,372 | 7/1994 | Tsuda et al. . | |
| 5,345,294 | 9/1994 | Nomura et al. . | |
| 5,383,011 | 1/1995 | Numagami et al. . | |
| 5,404,198 | 4/1995 | Noda et al. . | |
| 5,463,446 | 10/1995 | Watanabe et al. . | |
| 5,465,136 | 11/1995 | Watanabe . | |
| 5,475,470 | 12/1995 | Sasago et al. . | |
| 5,488,459 | 1/1996 | Tsuda et al. . | |
| 5,500,714 | 3/1996 | Yashiro et al. . | |
| 5,510,878 | 4/1996 | Noda et al. . | |
| 5,543,898 | 8/1996 | Shishido et al. . | |
| 5,561,504 | 10/1996 | Watanabe et al. . | |
| 5,583,613 | 12/1996 | Kobayashi et al. . | |
| 5,585,895 | 12/1996 | Yashiro et al. . | |
| 5,602,623 | 2/1997 | Nishibata et al. | 399/111 |
| 5,608,509 | 3/1997 | Shirai et al. | 399/351 |
| 5,617,579 | 4/1997 | Yashiro et al. | 399/114 |
| 5,623,328 | 4/1997 | Tsuda et al. | 399/111 |
| 5,640,650 | 6/1997 | Watanabe et al. | 399/117 |
| 5,659,847 | 8/1997 | Tsuda et al. | 399/113 |
| 5,669,042 | 9/1997 | Kobayashi et al. | 399/111 |
| 5,689,774 | 11/1997 | Shishido et al. | 399/111 |
| 5,749,027 | 5/1998 | Ikemoto et al. | 399/113 |
| 5,768,658 | 6/1998 | Watanabe et al. | 399/111 |
| 5,768,660 | 6/1998 | Kurihara et al. | 399/111 |
| 5,790,923 | 8/1998 | Oguma et al. | 399/106 |
| 5,794,101 | 8/1998 | Watanabe et al. | 399/103 |
| 5,809,374 | 9/1998 | Tsuda et al. | 399/111 |
| 5,828,928 | 10/1998 | Sasago et al. | 399/111 |
| 5,878,304 | 3/1999 | Watanabe et al. | 399/92 |
| 5,884,124 | 3/1999 | Karakama et al. | 399/123 |

FOREIGN PATENT DOCUMENTS

| | | |
|---|---|---|
| 0 770 932 A1 | 5/1997 | European Pat. Off. . |
| 7-121086 | 5/1995 | Japan . |

*Primary Examiner*—Matthew S. Smith
*Assistant Examiner*—Hoan Tran
*Attorney, Agent, or Firm*—Fitzpatrick, Cella, Harper & Scinto

[57] ABSTRACT

An end cover for a process cartridge detachably mountable to an electrophotographic image forming apparatus for forming an image on a recording material, includes a base; a gear train including a plurality of gears mounted on the base; a first opening, provided in the base so as to be opposed to a gear of the gear train, for permitting the gear of the gear train to be rotated externally when the end cover is mounted to a cartridge frame in assembling of the process cartridge; a second opening, provided opposed to the cartridge gear, for permitting observation of rotation of the cartridge gear provided in the cartridge frame which cartridge gear receives driving force through the gear train when the gear opposed to the first opening is rotated.

24 Claims, 15 Drawing Sheets

END COVER, PROCESS CARTRIDGE AND ASSEMBLING METHOD FOR PROCESS CARTRIDGE

FIELD OF THE INVENTION AND RELATED ART

The present invention relates to a process cartridge, an end cover usable therewith, and an assembling method for a process cartridge.

Here, the process cartridge means a cartridge which is detachably mountable relative to a main assembly of an electrophotographic image forming apparatus and which contains as a unit an electrophotographic photosensitive member, charging means, cleaning means or developing means. The process cartridge means a cartridge which is detachably mountable relative to a main assembly of an electrophotographic image forming apparatus and which contains as a unit an electrophotographic photosensitive member and at least one of charging means, cleaning means and developing means. The process cartridge means a cartridge which is detachably mountable relative to a main assembly of an electrophotographic image forming apparatus and which contains as a unit at least a developing means and an electrophotographic photosensitive member. The process cartridge can be mounted to and demounted from the main assembly by the user, so that maintenance operation of the main assembly of the apparatus can be easily effected by the user.

Here, the electrophotographic image forming apparatus means an apparatus using an electrophotographic image formation type process to form an image on a recording medium. Examples of the electrophotographic image forming apparatus includes an electrophotographic copying machine, an electrophotographic printer (laser beam printer, LED printer or the like), a facsimile machine and a word processor or the like.

In an image forming apparatus such as a copying machine, when it is operated for a long term, the necessities arise for exchange of the electrophotographic photosensitive drum, exchange of the developing device, supply of the toner, cleaning of the charger, exchange of the cleaner container or the like.

In a conventional electrophotographic image forming apparatus using the electrophotographic image forming process, a process cartridge type wherein the use is made with a process cartridge which is detachably mountable relative to the main assembly of the cartridge image forming apparatus and which contains as a unit electrophotographic photosensitive member and process means actable on it. With such a system, the maintenance of the apparatus can be effected by the user, and therefore, the operativity is remarkably improved.

When such a process cartridge is assembled, mounting and operations are inspected for each of the operation steps.

SUMMARY OF THE INVENTION

Accordingly, it is a principal object of the present invention to provide an end cover, process cartridge and an assembling method for the process cartridge wherein assembling operativity is improved.

It is another object of the present invention to provide an end cover, process cartridge and an assembling method for the process cartridge, wherein operation confirmation operations are easily carried out for mounted parts.

It is a further object of the present invention to provide an end cover, a process cartridge and an assembling method of the process cartridge wherein the parts can be mounted easily.

It is a further object of the present invention to provide an end cover, a process cartridge and an assembling method for a process cartridge with which the process cartridge can be assembled through automatic or manual assembling.

It is a further object of the present invention to provide an end cover, a process cartridge and an assembling method of a process cartridge wherein inspection can be carried out easily after the completion of assembling particularly as to gear mounting, operation confirmation or the like.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the embodiments of the present invention will be described with reference to the drawings.

Next, a preferable embodiment will be described. In the following description of the embodiment, a term "width direction" means the direction in which the process cartridge B is installed into, or removed from, the apparatus main assembly 33, and the "width direction" coincides with the direction in which recording medium is conveyed. A term "longitudinal direction" is the direction perpendicular (approximately) to the direction in which the process cartridge B is installed into, or removed from, the apparatus main assembly 33, and the "width direction" is parallel to the surface of the recording medium, being perpendicular (approximately) to the direction in which the recording medium is conveyed. Terms "left side" and "right side" of the process cartridge is the left side or the right side, respectively, of the process cartridge as the process cartridge B is seen from above and behind the recording medium being conveyed.

Figure 1:
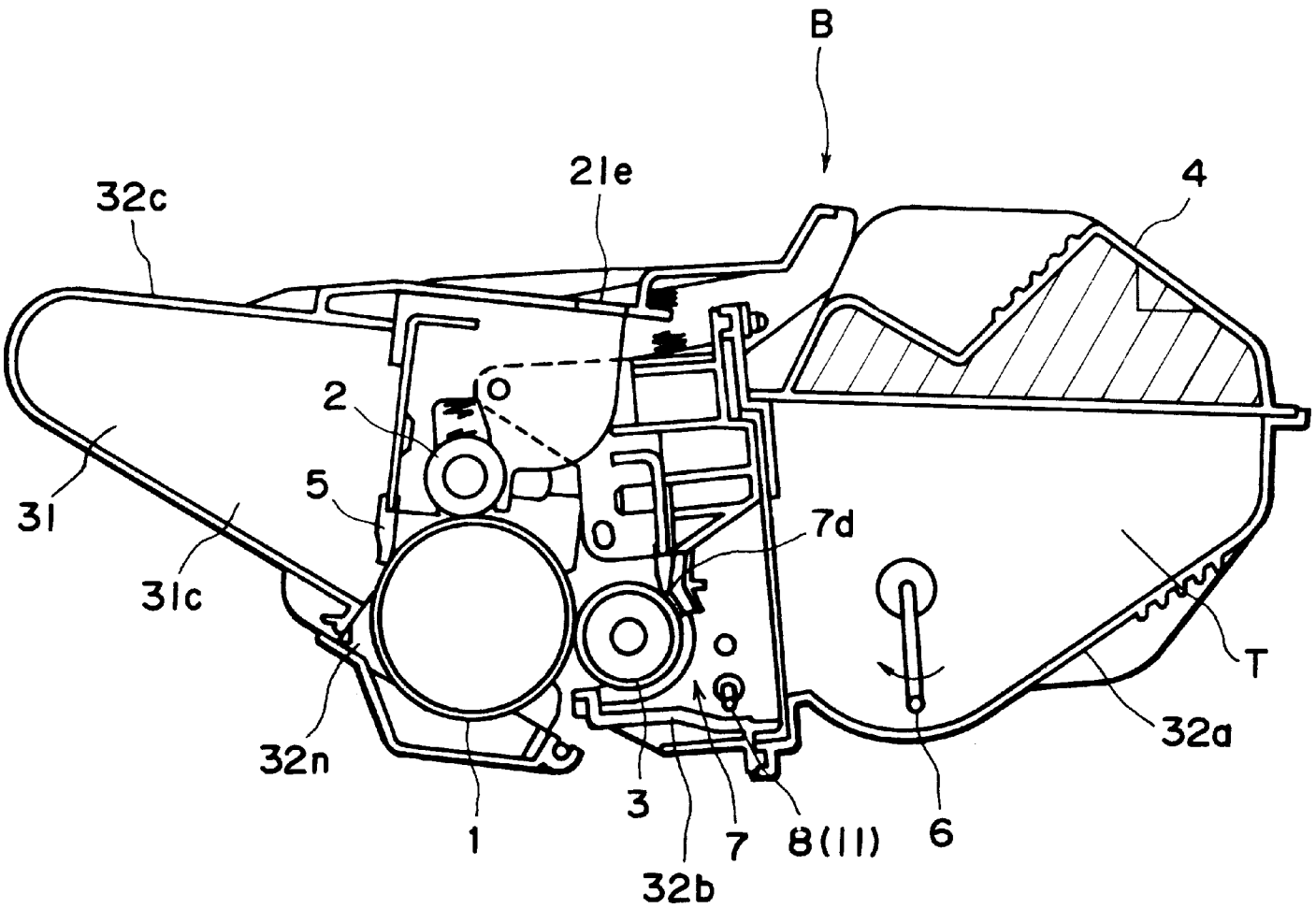
FIG. 1 is a longitudinal sectional view of a process cartridge according to an embodiment of the present invention.
Figure 2:
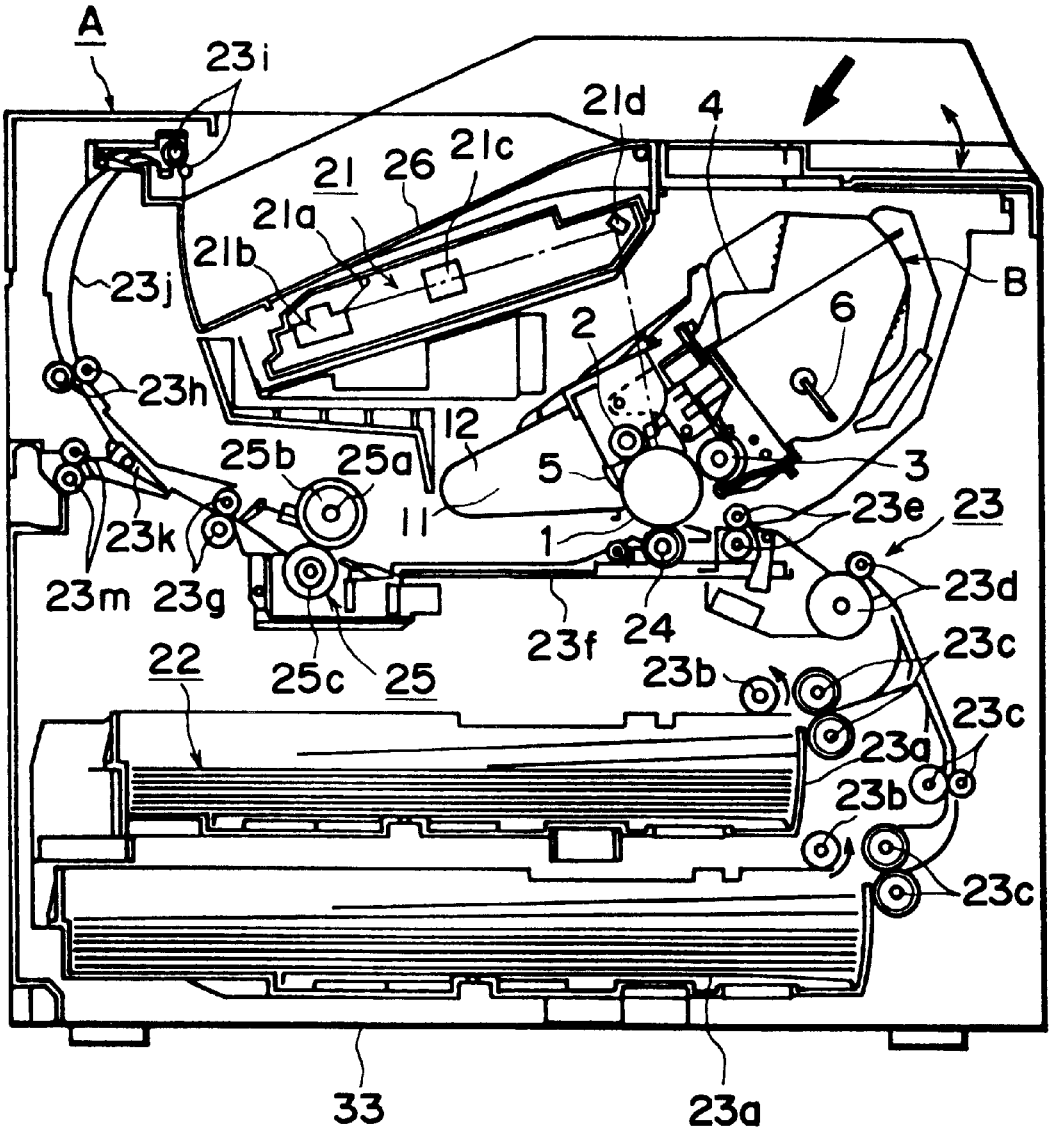
FIG. 2 is a longitudinal sectional view of an electrophotographic image forming apparatus to which a process cartridge is detachably mountable.
Figure 3:
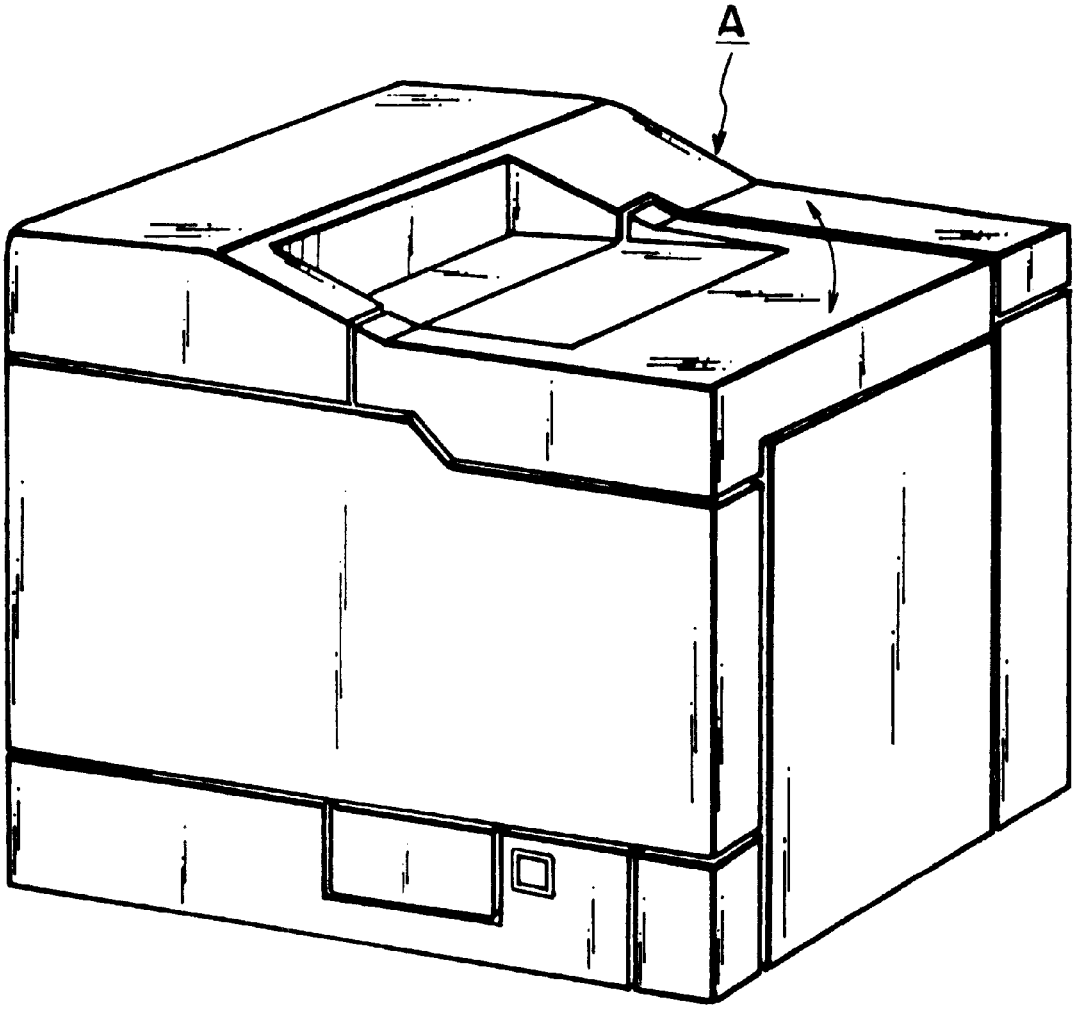
FIG. 3 is an outer appearance perspective view of the apparatus of FIG. 2.

FIG. 2 is a schematic vertical section of the electrophotographic image forming apparatus (laser beam printer) in, or from, which the process cartridge B in this embodiment is installable, or removable. It depicts the general structure of the apparatus. FIG. 3 is an external perspective view of the apparatus depicted in FIG. 2. FIG. 1 is a vertical section of a process cartridge in accordance with the present invention. In the following description of the present invention, a term "top surface" of the process cartridge means the process cartridge surface which faces upward when the process cartridge B is in the apparatus main assembly 33, and a term "bottom surface" of the process cartridge means the process cartridge surface which faces downward when the process cartridge B is in the apparatus main assembly 33.

Electrophotographic Image Forming Apparatus A and Process Cartridge B

First, referring to FIGS. 1 and 2, a laser beam printer A as an electrophotographic image forming apparatus in accordance with the present invention will be described. FIG. 1 depicts the cross section of the process cartridge B in accordance with the present invention.

Referring to FIG. 2, this laser beam printer A forms an image on a piece of recording medium (for example, a sheet of recording paper, a piece of OHP sheet, or a piece of fabric), with the use of an electrophotographic image forming process, in which a toner image is first formed on an electrophotographic photosensitive member in the form of a drum (hereinafter, "photosensitive drum"). More specifically, first, the photosensitive drum is charged by a charging means. Then, a laser beam modulated with image data is projected from an optical means onto the photosensitive drum. As a result, a latent image which reflects the image data is formed on the photosensitive drum. The latent image is developed into a toner image by an image developing means. Meanwhile, in synchronism with the formation of the toner image, a piece of recording medium 22 set in a cassette 23*a* is picked out of the cassette 23*a* by a pickup roller 23*b*, and is conveyed by two pairs of conveyer rollers 23*c* and 23*d*, and a pair of registration rollers 23*e*, being flipped over once as it is conveyed. Next, the toner image formed on the photosensitive drum 1 in the process cartridge B is transferred onto the recording medium 22 by applying voltage to a transfer roller 24 as an image transferring means. After receiving the toner image, the recording medium 22 is conveyed to an image fixing mean 25 by a conveyer guide 23*f*. The fixing means 25 comprises a driving roller 25*c*, and a fixing roller which contains a heater 25*a*. As the recording medium is conveyed through the fixing means 25, heat and pressure are applied to the recording medium 22 and the toner image, permanently fixing the toner image to the recording medium 22. Thereafter, the recording 22 is conveyed by three pairs of discharging rollers 23*g*, 23*h*, and 23*i*, and finally is discharged, through a reversing path 23*j*, into a delivery tray 26. The delivery tray 26 is located at the top of the apparatus main assembly 33 of the image forming apparatus A (it constitutes a part of the top surface of the apparatus main assembly 33 of the image forming apparatus A. The recording medium 22 may be discharged from the apparatus main assembly 33 by a pair of discharge rollers 23*m*, without passing it through the reversing path, by operating a switchable flapper 23*k*. In this embodiment, the conveying means 23 is constituted of the pickup roller 23*b*, the pairs of conveyer rollers 23*c* and 23*d*, the pair of registration rollers 23*e*, the conveyer guide 23*f*, the pairs of discharge rollers 23*g*, 23*h*, and 23*i*, and the pair of discharge roller 23*m*.

On the other hand, in the process cartridge B, the photosensitive drum 1, the surface of which is constituted of a photosensitive layer, is rotated, as shown in FIG. 1, and this surface layer is uniformly charged by applying voltage to a charge roller 2 as a charging means. Then, a laser beam modulated with image data is projected from an optical system 21 to the photosensitive drum 1, through an exposure opening 21*e*. As a result, a latent image is formed on the surface of the photosensitive drum 1. The latent image is developed with the use of toner and a development sleeve 3. More specifically, the charge roller 2 is placed in contact with the photosensitive drum 1, to charge the photosensitive drum 1. It follows the rotation of the photosensitive drum 1. The developing device 7 supplies toner to the image developing station, in which the toner is supplied to the peripheral surface of the photosensitive drum 1, developing the latent image formed on the photosensitive drum 1. The optical system 21 is constituted of a laser diode 21*a*, a polygon mirror 21*b*, a lens 21*c*, and a reflection mirror 21*d*.

More specifically, regarding the developing device 7, the toner in the toner container 4 is sent out toward a development sleeve 3, which is being rotated, and in which a magnet is fixedly disposed. As the toner sent toward the development sleeve 3 meets the development sleeve 3, a layer of triboelectrically charged toner is formed on the peripheral surface of the development sleeve 3 by a development blade 7. Then, the triboelectrically charged toner on the peripheral surface of the development sleeve 3 is supplied to the portion of the peripheral surface of the photosensitive drum 1, in the development station; the latent image is developed into a toner image, that is, visualized, by transferring the toner onto the peripheral surface of the photosensitive drum 1 in a manner to reflect the latent image. The development blade 7*d* regulates the amount of the toner coated on the peripheral surface of the development sleeve 3, and also triboelectrically charges the toner as it coats the development sleeve 3. Adjacent to the development sleeve 3, a toner stirring member 8 as a toner conveying member, which circulates the toner in the development chamber, is rotatively attached.

The toner image formed on the photosensitive drum 1 is transferred onto the recording medium 22 by applying to a transfer roller 24, voltage with the polarity opposite to that of the toner image. Thereafter, the residual toner, which is remaining on the photosensitive drum 1, is removed by a cleaning means 31; the toner remaining on the photosensitive drum 1 is scraped into a waste toner bin 31*c*, by an elastic cleaning blade 5 placed in contact with the photosensitive drum 1.

The process cartridge B comprises a toner frame 32*a*, a development frame 32*b*, and a cleaning frame 32*c*. The toner frame 32*a* comprises a toner container 4 (toner holding portion) for holding toner. The development frame 32*b* holds image developing means such as the development sleeve 3. The cleaning frame 32*c* contains the photosensitive drum 1, the cleaning means 31 such as the cleaning blade 5, and the charge roller 2. In assembling the process cartridge B, first, the toner frame 32*a* and the development frame 32*b* are joined, and the cleaning frame 32*c* is connected to the unit composed of the toner frame 32*a* and the development frame 32*b*. The thus assembled process cartridge B can be easily installed into, or removed from, the apparatus main assembly 33 by an average operator.

The process cartridge B is provided with an exposure opening 21*e* and a transfer opening 32*n*. The exposure opening 21*e* is an opening through which a light beam modulated with the image data is projected onto the photosensitive drum 1. The transfer opening 32*n* is an opening through which the photosensitive drum 1 and the recording medium 22 are placed in contact with each other. More specifically, the exposure opening 21*e* is a part of the cleaning frame 32*c*, and the transfer opening 32*n* is a gap created between the development frame 32*b* and the cleaning frame 32*c*.

Next, the structure of the housing of the process cartridge B in this embodiment will be described.

The process cartridge B in this embodiment is formed in the following manner. First, the toner frame 23*a* and the development frame 32*b* is joined, and then, the cleaning frame 32*c* is rotatively connected to the unit formed by joining the toner frame 32*a* and the development frame 32*b*, completing the housing of the process cartridge B. Then, the photosensitive drum 1, the charge roller 2, the development sleeve 3, the cleaning blade 5, and the like, are disposed in the housing, to complete the process cartridge. This process cartridge B is removably fitted into the cartridge installing means provided in the apparatus main assembly 33.

Referring to FIG. 1, to the toner frame 32*a*, the toner stirring device 6 is rotatively attached, and to the development frame 32*b*, the development sleeve 3 and the development blade 7*d* are attached. Adjacent to the development sleeve 3, the toner stirring device 8, which is also the toner conveying member for circulating the toner in the development chamber, is rotatively attached.

A part of the toner frame 32*a* constitutes the toner container 4, which is filled with toner T. During an image forming operation, the toner stirring device 6 is rotatively driven in the direction of an arrow mark, to send the toner T within the toner container into the development frame 32*b*. In the development frame 32*b*, the toner stirring device 8 which is rotated during a development operations is provided to stir the toner in the development frame 32*b*. The toner stirring device 6 is rotatively supported by the toner frame 32*a*. The toner stirring device 8 is rotatively supported by the development frame 32*b*. The toner stirring device 8 and the toner stirring device 6 are connected to each other with a driving force transmitting gear train, so that the two toner stirring devices rotate in concert.

Figure 4:
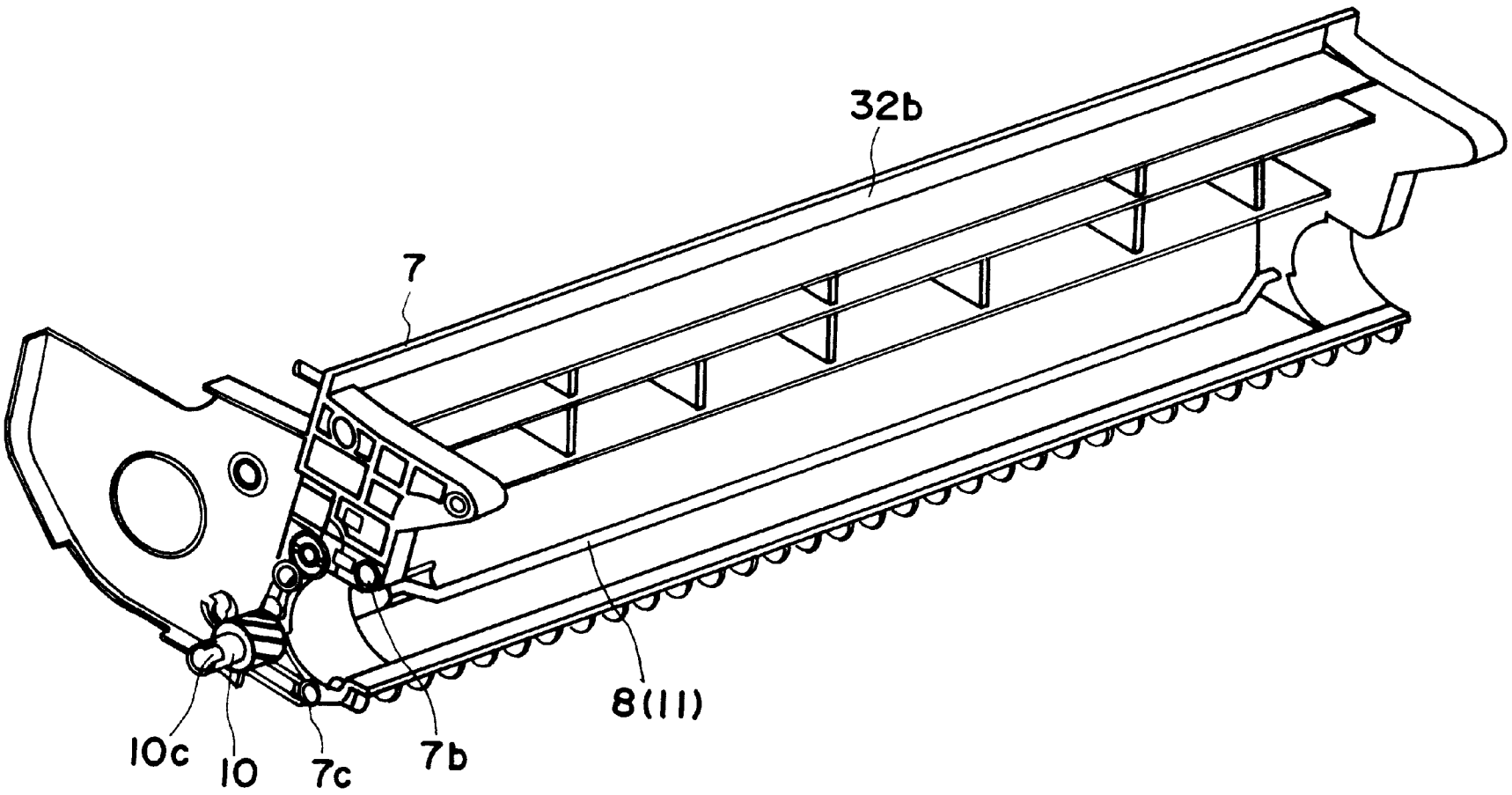
FIG. 4 is a perspective view of a developing device to which a development stirring gear and a development stirring rod are mounted.
Figures 5A, 5B:
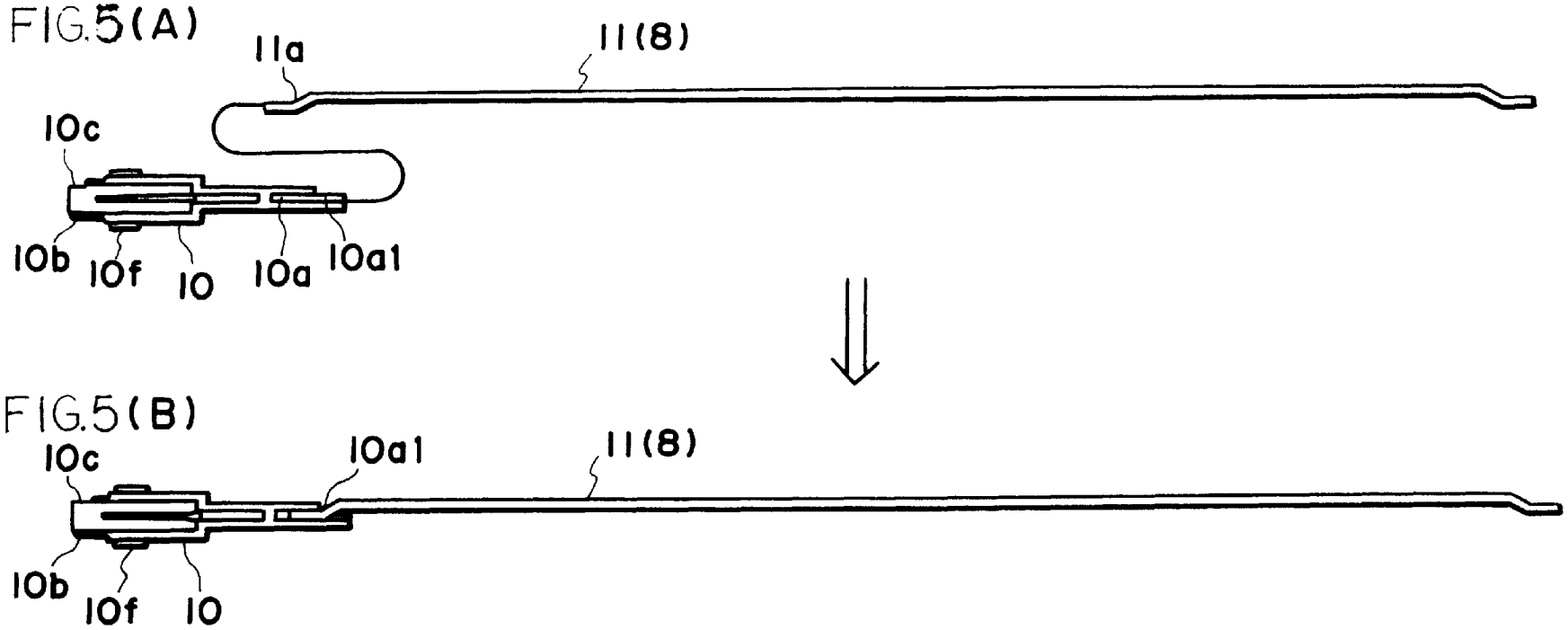
FIGS. 5, (A), (B) are longitudinal sectional view showing engagement between a development stirring gear and a development stirring rod.

FIG. 4, a perspective view, depicts how a toner stirring device gear 10 is assembled into the developing device 7. The toner stirring device gear 10 attached to the developing device 7 is fitted with a stirring rod 11, in the developing device 7, in such a manner, as shown in FIG. 5, (A), a sectional drawing, that the toner stirring device gear 10 and the stirring rod 11 do not rotate relative to each other. More specifically, referring to FIGS. 5A and 5B, the inward end of the toner stirring device gear 10 constitutes the stirring rod supporting portion 10*a*, which is provided with a hole in which the stirring rod 11 is inserted. A part of this stirring rod supporting portion 10*a*, i.e., the top side in FIG. 5, is cut off to form a cut portion 10*a*1. On the other hand, the end portion of the stirring rod 11 is bent in the form of a crank, forming a crank portion 11*a*, which is inserted into the rod hole of the stirring rod supporting portion 10*a*. As the crank portion 11*a* is inserted into the rod hole of the rod supporting portions 10*a* with the cut portion 10*a*1, the arm portion of the crank portion 11*a* come in contact with the edges of the cut portion 10*a*1, being thereby prevented from rotating relative to the toner stirring device gear 10; in other words, the stirring rod 11 and the toner stirring device gear 10 are connected to each other in such a manner that they do not rotate relative to each other.

Figure 6:
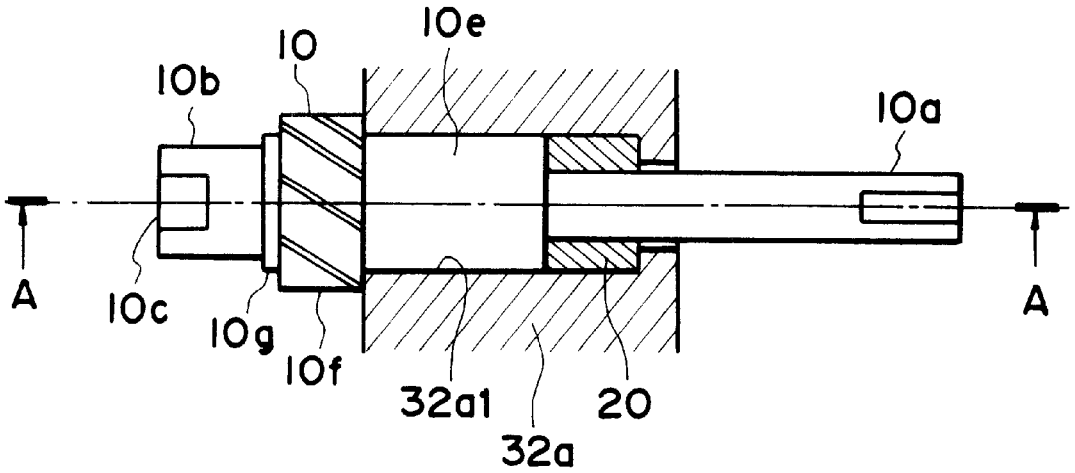
FIG. 6 is a side view of a development stirring gear.

Referring to FIG. 6, the toner stirring device gear 10 comprises a journal portion 10*e* and the stirring rod supporting portion 10*a*. The journal portion 10*e* rotatively fits in the bearing 32*a*1, which is a hole cut in the lateral wall, i.e., the wall at the longitudinal end, of the development frame 32*b*, and has a step. The stirring rod supporting portion 10*a* is on the inward side of the journal 10*e*. The toner stirring device gear 10 also comprises a gear portion 10*f*, an axial portion 10*b*, and a step portion 10*g*, which are on the side opposite to the stirring rod supporting portion 10*a*. The axial portion 10*b* is inserted in a hole as a bearing (unillustrated) in the lateral wall of the developing means holder 12, so that the toner stirring device gear 10 is supported by the developing means holder 12. The step portion 10*b* is located between the axial portion 10*b* and the gear portion 10*f*. After the insertion of the axial portion 10*b* into the bearing hole of the developing means holder 12, the inward surface of the developing means holder 12 is positioned right next to the vertical portion of the step portion 10*g*, and the lateral surface of the gear portion 10*f* is placed in contact with the outward surface of the lateral wall, i.e., the wall on the longitudinal end, of the development frame 32*b*, properly positioning the toner stirring device gear 10 in terms of its axial direction.

The base side of the stirring rod supporting portion 10*a* is fitted with a cylindrical sealing member 20, the outer peripheral surface of which fits against the internal wall of the bearing hole 32*a*1 of the development frame 32*b*.

Figure 7:
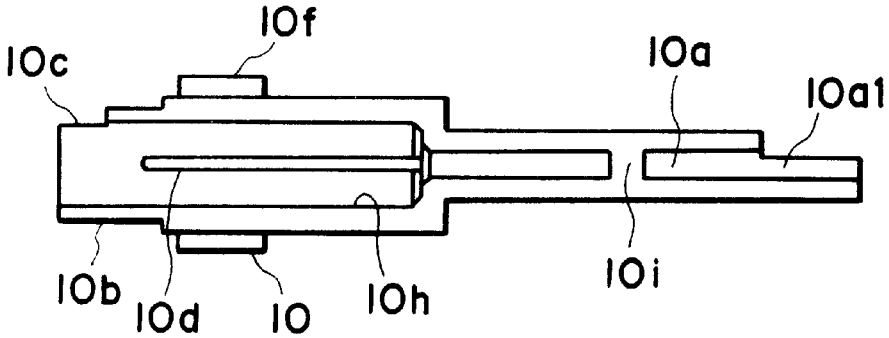
FIG. 7 is a sectional view taken along a line A—A of FIG. 6.

Next, referring to FIG. 7, the sections of the toner stirring device gear 10 between the left end of the axial portion 10*c* and the border between the journal portion 10*e* and the stirring rod supporting portion 10*a* has a large diameter, and contains a cylindrical hole, which extends beyond the journal portion 10*e*, through the stirring rod supporting portion 10*a*, up to a stopper wall 10*i* located at the approximate mid point between the outer and inner ends of the stirring rod supporting portion 10*a*. The peripheral surface of this hole is provided with ribs 10*d*, which stand perpendicular to the axial direction of the hole, being arranged in the cross sectional pattern of a cross, for example.

The above described toner stirring device gear 10 is a single piece component formed of resin.

Figure 8:
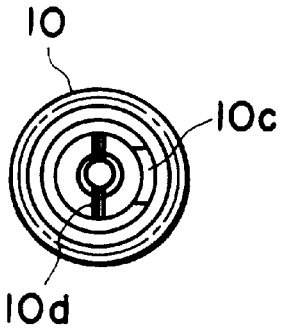
FIG. 8 is a front view of the device of FIG. 6.
Figure 9:
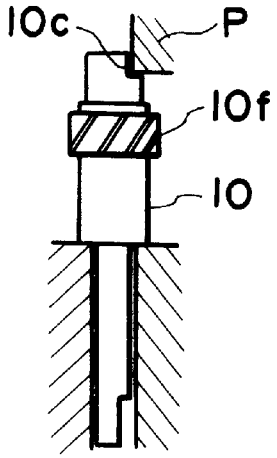
FIG. 9 is a front view showing the development stirring gear which is being fed by a parts feeder.
Figure 10:
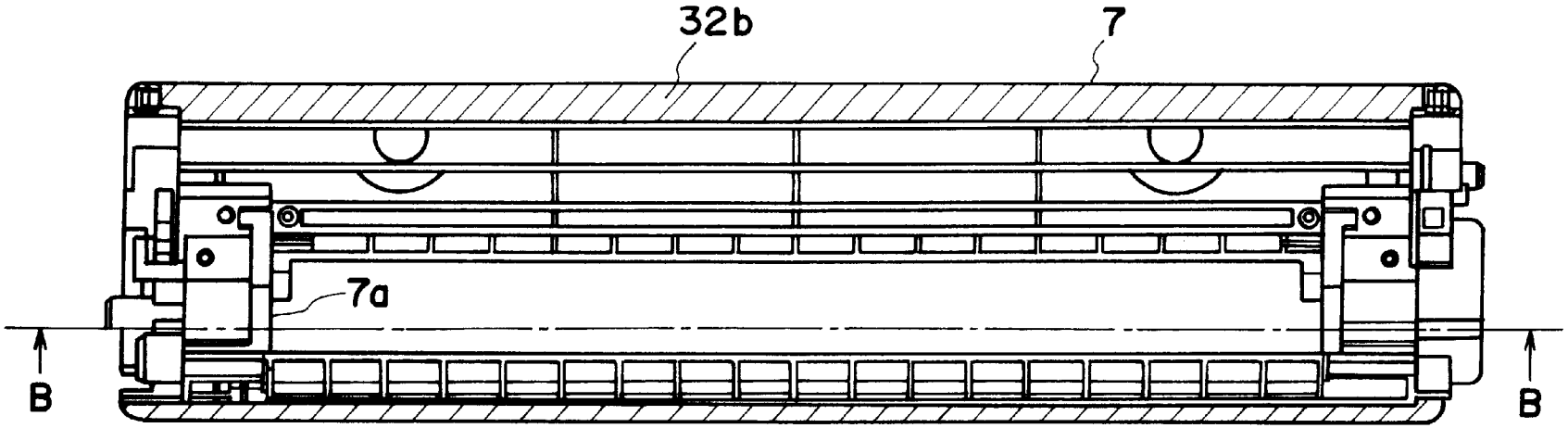
FIG. 10 is a side view illustrating a development stirring gear and mounting of a development stirring rod to a developing device.

Referring to FIGS. 6, 7, and 8, in order to meet the requirement for assembling a process cartridge B using an automated machine, the cylindrical axial portion 10*b* of the toner stirring device gear 10, on the side opposite to the stirring rod supporting portion 10*a*, is provided with a notch 10*c* for properly positioning the toner stirring device gear 10*a* in terms of the rotational direction (rotational phase), and the ribs 10*d* are disposed in the hole in the axial portion 10*b*.

Next, referring to FIGS. 9–13, a process for automated assembling of the stirring rod 11 and the toner stirring device gear 10 into the developing device 7 will be described through each step in the process. In conveying the toner stirring device gear 10 using a part feeder, the position finder notch 10*c* is placed in contact with the wall surface P of the part feeder, so that the toner stirring device gear 10 is prevented from rolling on the part feeder while being conveyed. The portion to be placed in contact with the wall surface P of the part feeder does not need to be limited to the notch 10*c*; if flat portions are present on the peripheral surface of the toner stirring device gear 10, any of the flat portions may be placed in contact with the wall surface P to prevent the rolling of the toner stirring device gear 10 during its conveyance. Further, instead of controlling the rolling of the toner stirring device gear 10 with the use of the wall surface P while conveying the toner stirring device gear 10, a part picking machine, the tip of which is given such a shape that snugly fit in the notch 10*c*, may be employed. In the latter case, the angle by which the tip of the part picking machine is rotated, is detected.

Figure 11:
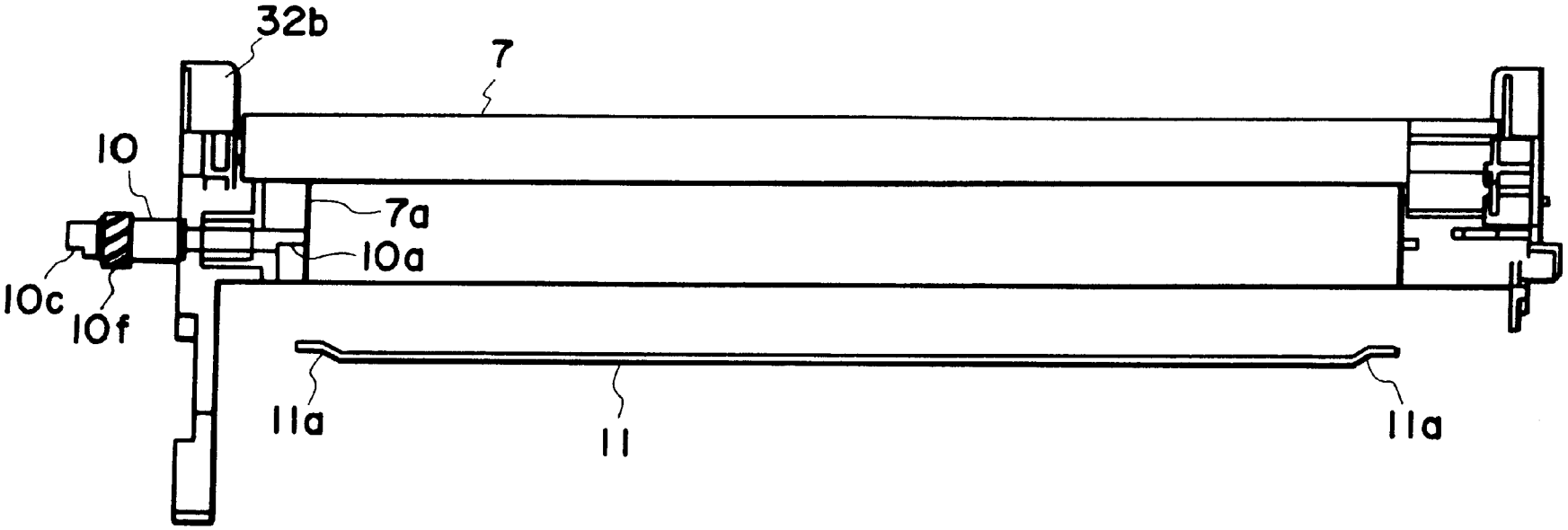
FIG. 11 is a side view illustrating a development stirring gear and mounting of a development stirring rod to a developing device.
Figure 12:
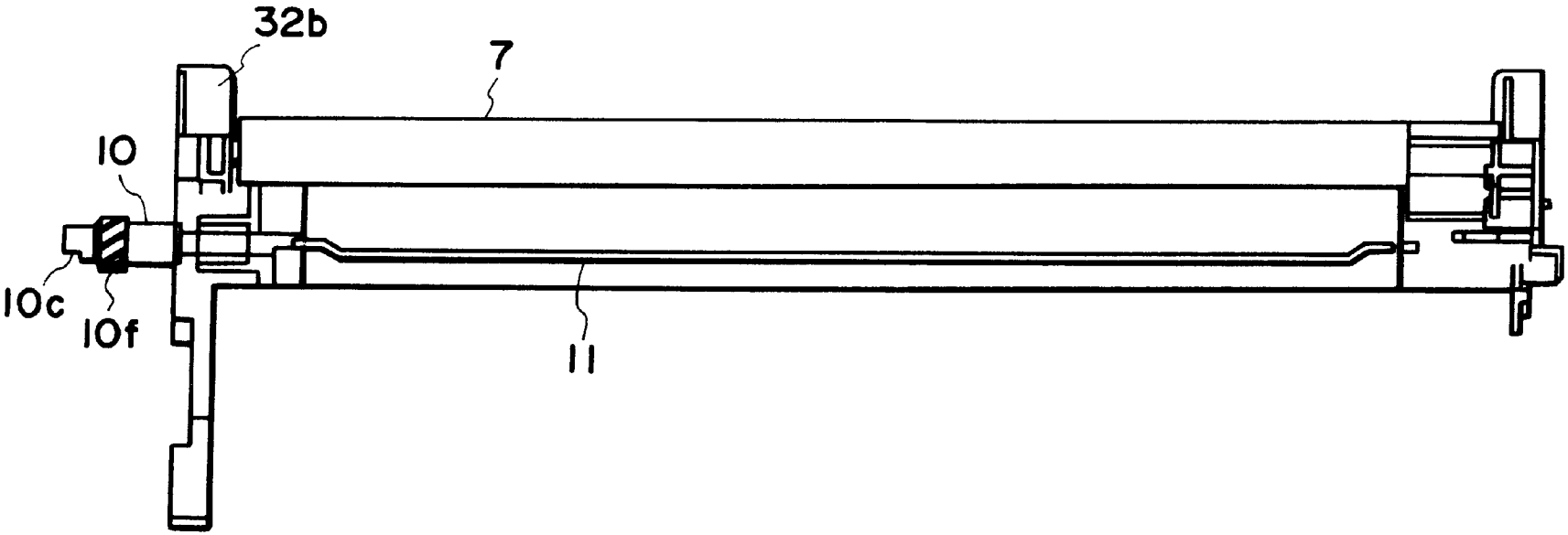
FIG. 12 is a side view illustrating a development stirring gear and mounting of a development stirring rod to a developing device.
Figure 13:
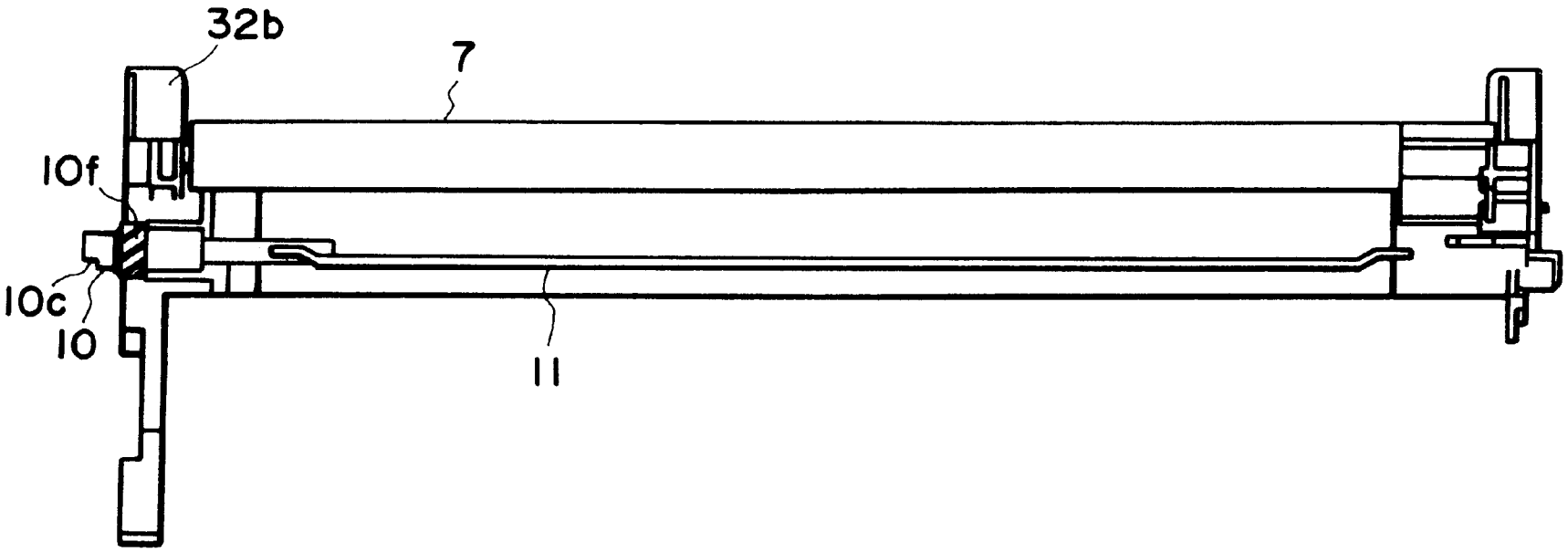
FIG. 13 is a side view illustrating a development stirring gear and mounting of a development stirring rod to a developing device.

Next, the toner stirring device gear 10 is clamped by the part picking machine, by the ribs 10*d* located on the internal peripheral wall of the toner stirring device gear 10, or by the axial portion 10*b* of the toner stirring device gear 10, and is picked up. Then, the toner stirring device gear 10 is inserted halfway into the developing device 7 so that the stirring rod supporting portion 10*a*, i.e., the inward end of the toner stirring device gear 10, does not stick out into the developing device 7 beyond the opening 7*a* of the developing device 7 (FIG. 11). Next, the stirring rod 11 is clamped, by the crank portion 11*a*, and is moved into the developing device 7 to a position at which the axial line of the stirring rod 11 coincides with the axial line of the toner stirring device gear 10 (FIG. 12). Then, the toner stirring device gear 10 is pushed inward to engage the stirring rod 11 and the toner stirring device gear 10 (FIG. 13), completing the automated assembly of the stirring rod 11 and the toner stirring device gear 10 into the developing device 7. With this engagement between the stirring rod 11 and the toner stirring device gear 10, the crank arm of the crank portion 11*a* fits in the cut portion 10*a*1, extending in the radial direction of the cut portion 10*a*1, and therefore, preventing the toner stirring device gear 10 and the stirring rod 11 from rotating relative to each other.

It should be noted here that if the above described assembly process is manually carried out, the presence of the notch 10*c* and the ribs 10*d* is irrelevant to the assembly process.

Figure 14:
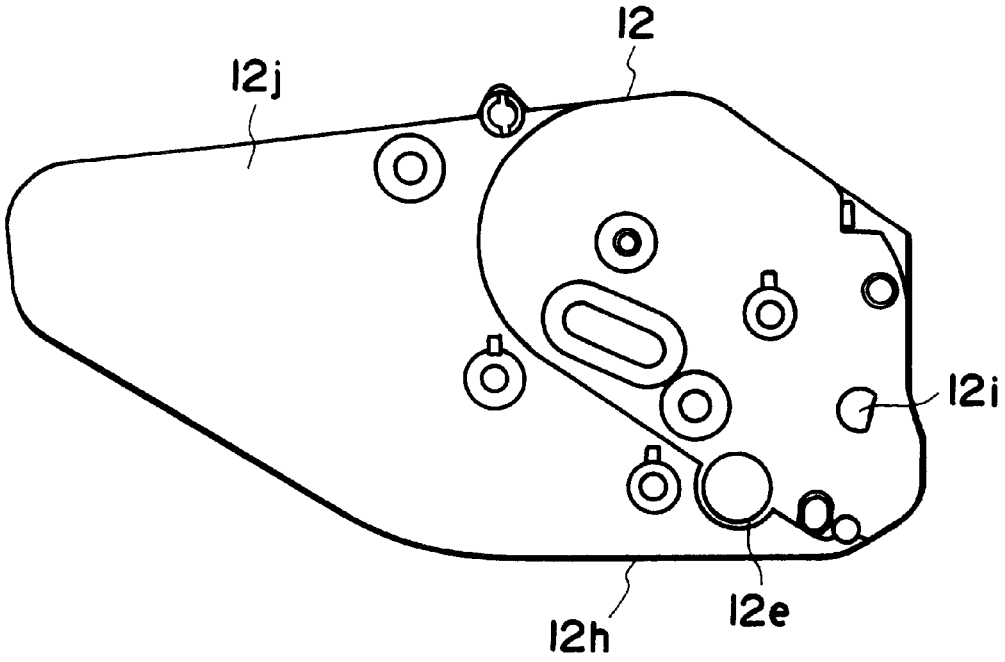
FIG. 14 is an external view of a development holder.
Figure 15:
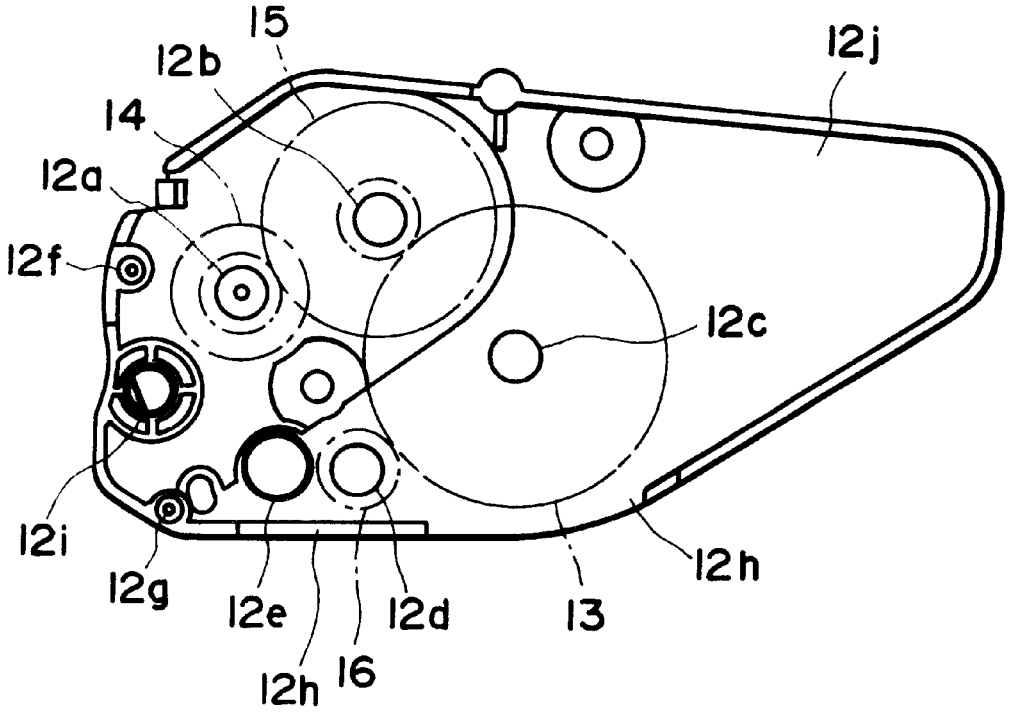
FIG. 15 is an internal view of a development holder.
Figure 18:
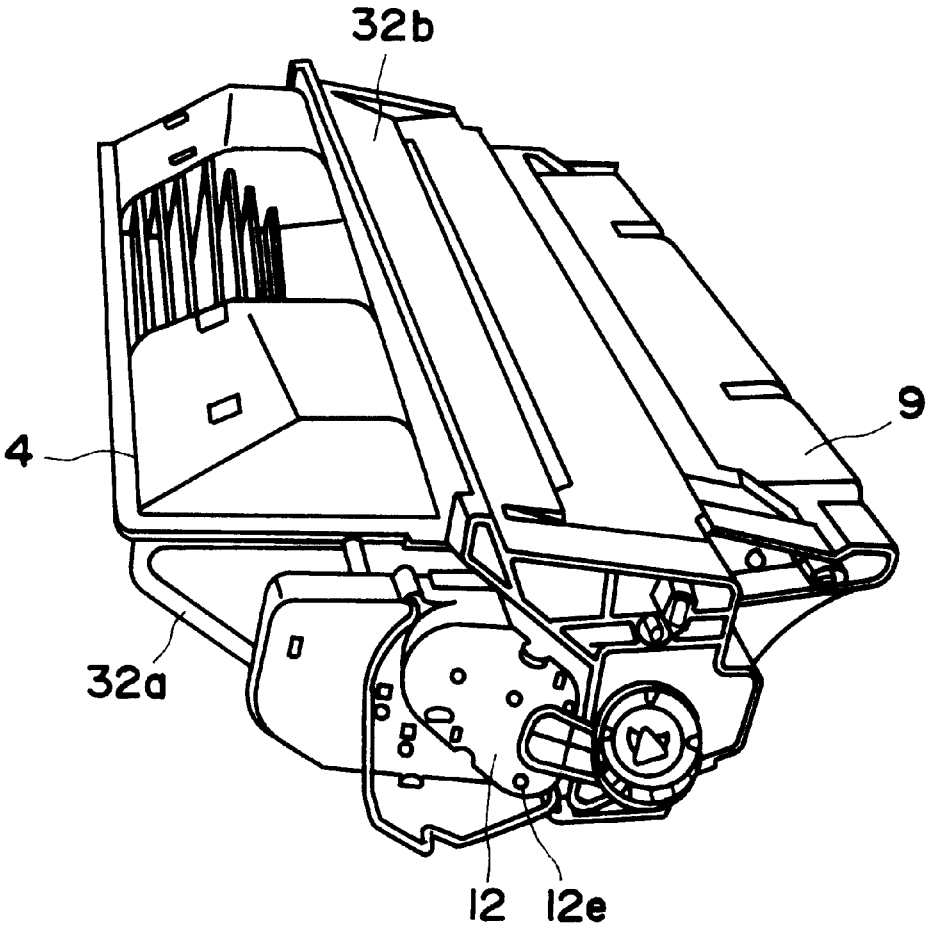
FIG. 18 is a perspective view of a process cartridge according to an embodiment of the present invention.

FIGS. 14 and 15 are plan views of the external and internal surfaces, respectively, of the developing means holder 12 as a lateral end cover for the developing device 7. Referring to FIG. 18, the developing means holder 12 is fixed to the toner frame 32*a* and the development frame 32*b*, which are the parts of the cartridge frame, covering the longitudinal ends of the development frame 32. On the inward side of the developing means holder 12, a gear train is located as the means for transmitting the force for driving the toner stirring device 6. Also on the inward side of the base portion 12*j* of the developing means holder 12, dowels 12*a*, 12*b*, 12*c*, and 12*d* are provided, as shown in FIG. 15. Around these dowels, a toner stirring device gear 13 for the toner stirring device 6 in the toner container 4, and idler gears 14, 15, and 16, are rotatively fitted. The idler gears 14 and 15 are compound gears with two different gear portions with different diameters. In a through hole 12*e*, the aforementioned toner stirring device gear 10 is fitted. Projections 12*f* and 12*g* fit into the hole 7*b* and 7*c*, respectively, of the developing device 7 so that the developing means holder 12 is correctly positioned relative to the developing device 7 when the developing means holder 12 is attached to the developing device 7 (FIG. 4). The bottom portion of the developing means holder 12 is provided with an opening 12*h* (first opening), through which an external gear is meshed with the toner stirring device gear 13.

Figure 17:
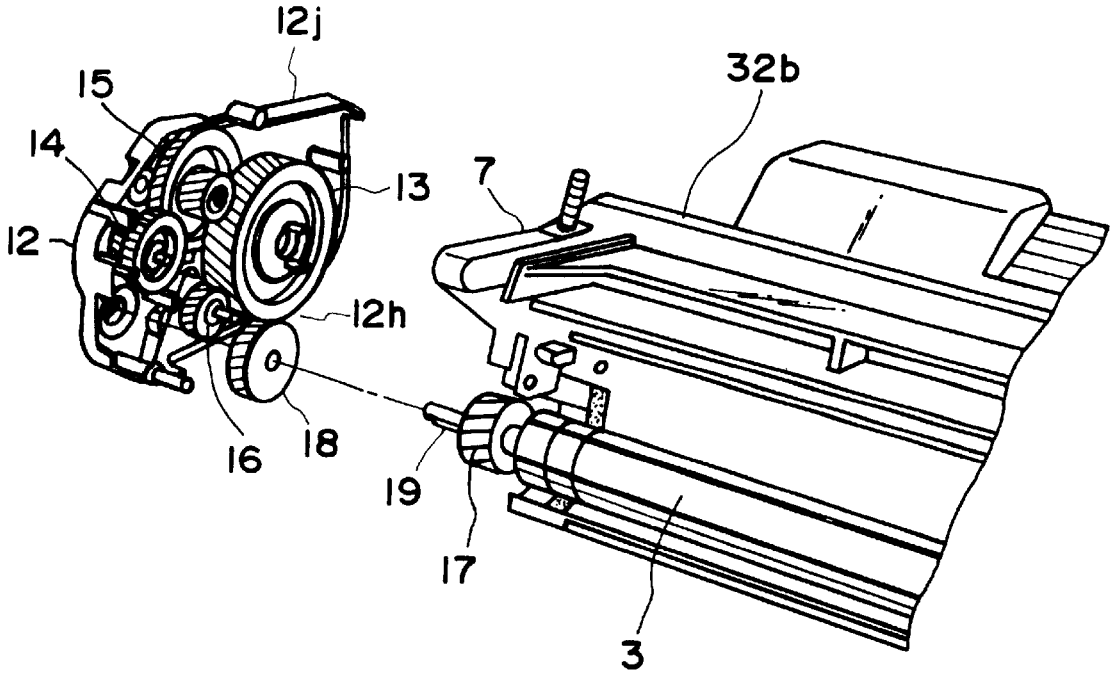
FIG. 17 is a perspective view when a development holder is being mounted to the developing device.

Next, the assembly step for attaching developing means holder 12 to the developing device 7 will be described. Prior to this assembly step, the toner stirring device gear 13, and the idler gears 14, 15, and 16, are attached to the developing means holder 12. Also prior to this assembly step, a sleeve gear 17 (being fitted coaxially with development sleeve 3, and engaging with idler gear 14), and the toner stirring device gear 10 (behind development sleeve 3 in FIG. 17), are attached to the lateral wall of the developing device 7. If an attempt is made to attach the developing means holder 12 to the developing means 7 with no regard to the rotational phases (rotational angle) of these gears 10, 13, 14, 15, 16, and 17, it is possible that the teeth of the gears may be excessively worn or may be damaged. Therefore, in order to prevent such a problem, first, a gear 18 (gear used for assembly, or test, of process cartridge) is engaged with the toner stirring device gear 13, from outside, through the bottom opening 12*h* of the developing means holder 12, and then, the developing means holder 12 is pressed toward the developing device 7 while rotating the gears 13, 14, 15, and 16, through the gear 18. With this method, the gears 13, 14, 15, 16, and 17 smoothly mesh with their counterparts, allowing the developing means holder 12 to be attached to the developing device 7 without causing excessive wear or damages to the teeth of these gears.

Figure 16:
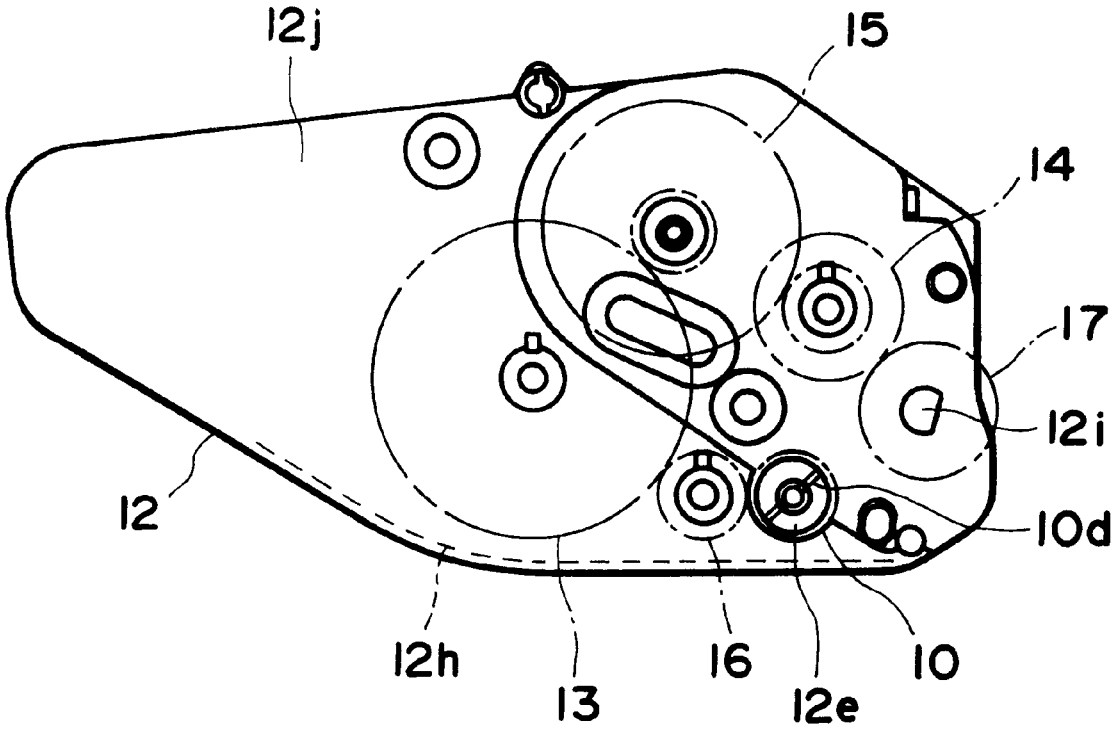
FIG. 16 is a side view showing a disposition of a gear when it is mounted on a development holder.

At this time, the gear train attached to the developing means holder 12, on the side which becomes the inward side as the developing means holder 12 is attached to the developing device 7, will be described with reference to FIG. 16, which is a lateral plan view of the developing means holder 12 as seen from the outward side. At the completion of the step for attaching the developing means holder 12 to the developing device 7, the sleeve gear 17 already has been coaxially disposed with a hole 12*i* cut through the developing means holder 12 for supporting a magnet 19 contained in the development sleeve 3, and also already has been in engagement with the idler gear 14. Driving force is transmitted in the order of the sleeve gear 17, the idler gear 14, the idler gear 15, the toner stirring device gear 13, the idler gear 16, and then, finally to the toner stirring device gear 10, which is the final follower gear.

Figure 19:
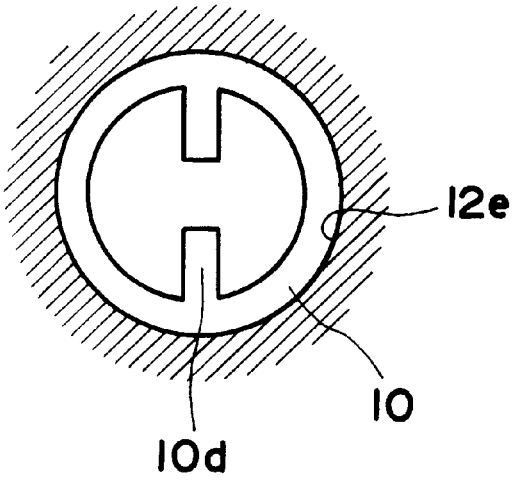
FIG. 19 is an enlarged view of a development stirring gear as seen through a through-hole of a development holder.

Thus, in order to find the assembly errors after the completion of the entire steps for assembling a process cartridge such as the one depicted by FIG. 18, all that is necessary is to transmit the driving force, and then confirm from outside, through the through hole 12*e*, that the toner stirring device gear 10 as the final follower gear is rotating. Further, referring to FIG. 19, which is an enlarged view of the through hole 12*e* as the second opening, the provision of the ribs 10*d* within the toner stirring device gear 10 makes it easier to find out the rotational state of the toner stirring device gear 10.

Figure 20:
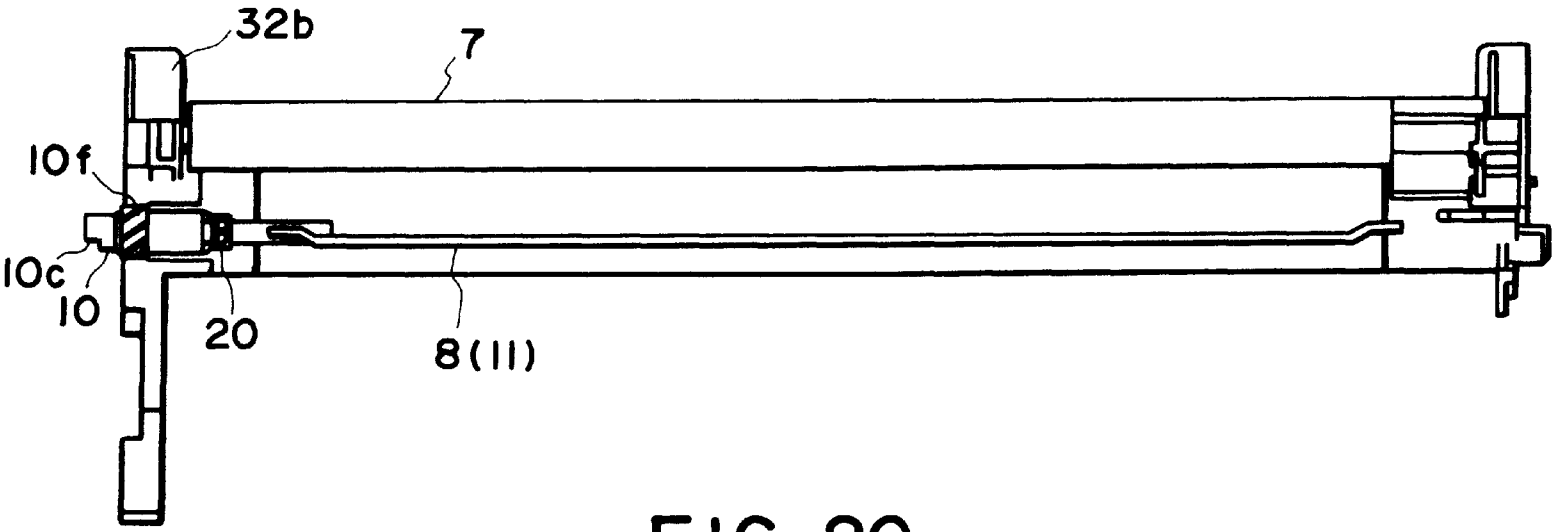
FIG. 20 is a sectional view illustrating sealing at an engaging portion between a development stirring gear and developing device.
Figure 21:
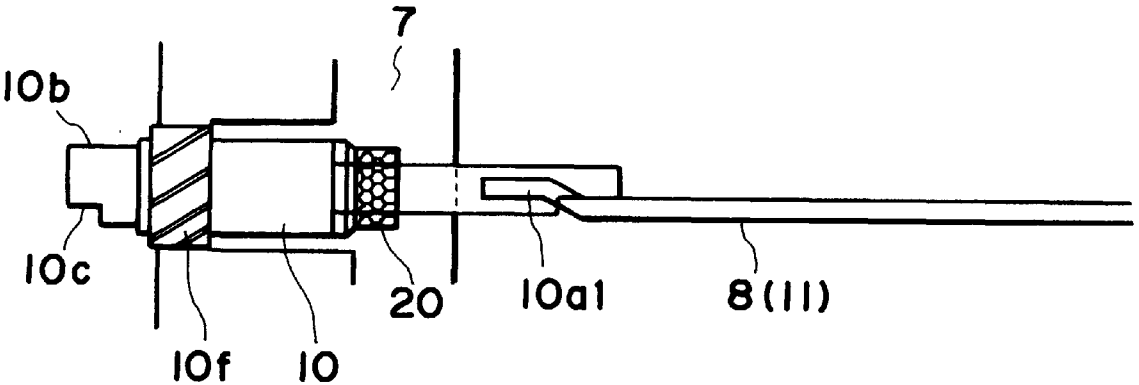
FIG. 21 is an enlarged view of a part of FIG. 20.

Further, in addition to being used as the portion by which the toner stirring device gear 10 is clamped when the toner stirring device gear 10 is picked up from the part feeder, and also being used as the portion to be observed to determine whether or not mistakes have been made in the gear attaching process, the ribs 10*d* can be used to confirm whether or not a sealing member for preventing the toner leak from between the developing device 7 and the toner stirring device gear 10 has been installed. More specifically, referring to FIG. 20, which is a sectional view of the toner stirring means in the developing device, and FIG. 21, which is a schematic side view of the toner stirring device gear 10 and the stirring rod 11, first, the sealing member 20 formed of felt or oil seal is placed in the hole (bearing) cut in the lateral wall of the developing device 7, and then, the toner stirring device gear 10 is inserted into the hole so that the sealing member is compacted between the hole surface and the toner stirring device gear 10 to seal the gap between them. In order to confirm whether or not the sealing member was inserted during the automated assembly process, all that is necessary is to measure the torque necessary to rotate the toner stirring device gear 10, after the toner stirring device gear 10 and the stirring rod 11 are attached to the developing device 7; the torque value is higher when the sealing member is present. The torque necessary to rotate the toner stirring device gear 10 can be simply measured by inserting into the internal hole of the toner stirring device gear 10, a torque measuring jig, the tip of which is given a pattern which matches the pattern in which the ribs 10 are arranged, and then turning the toner stirring device gear 10 with the jig.

The embodiments of the end cover are summarized as follows:

An end cover for a process cartridge (B) detachably mountable to an electrophotographic image forming apparatus (A) for forming an image on a recording material, said end cover (development holder 12) comprising:

a base (12*j*);

a gear train (toner stirring gear 13, idler gears 14, 15, 16) including a plurality of gears mounted on said base;

a first opening (opening 12*h*), provided in said base so as to be opposed to a gear (toner stirring gear 13) of said gear train, for permitting the gear of said gear train to be rotated externally when said end cover is mounted to a cartridge frame (toner frame 32*a*, developing frame 32*b*) in assembling of said process cartridge;

a second opening (through-hole 12*e*), provided opposed to said cartridge gear, for permitting observation of rotation of the cartridge gear provided in the cartridge frame which cartridge gear (development stirring gear 10) receives driving force through said gear train when the gear opposed to said first opening is rotated.

Said gear train receives rotation driving force from a developing roller gear (sleeve gear 17) provided at one end of a developing roller (developing sleeve 3) contained in said process cartridge, and transmits the rotation driving force to a toner feeding member (development stirring device 8) for feeding the toner in a developer chamber provided with a developing roller contained in said process cartridge.

Said cartridge gear is a gear (development stirring gear 10) of the toner feeding member provided at one end of said toner feeding member, wherein said gear of the toner feeding member is provided with a rib (rib 10*d*) at a side faced to said gear of the toner feeding member, and wherein said rib can be observed from outside of said end cover through said second opening.

Said rib is effective to match phase between said gear of the toner feeding member and said toner feeding member when they are connected.

Said cartridge gear is a gear of the toner feeding member provided at one end of said toner feeding member, wherein said gear of the toner feeding member is provided with a cut-away portion (10*c*) at a side faced to said second opening, and wherein said cut-away portion can be observed from outside of said end cover through said second opening.

Said cut-away portion is effective to match phase between said gear of the toner feeding member and said toner feeding member when they are connected.

When said end cover is mounted to a cartridge frame in assembling said process cartridge, a gear is inserted through said first opening and is engaged with a gear (toner stirring gear 13) opposed to said first opening, and said gear train is rotated.

Phases are matched between a gear (idler gear 14, 16) of said gear train, said developing roller gear (sleeve gear 17) and said gear of the toner feeding member (development stirring gear 10) by rotation of said gear train.

There is further provided:

A process cartridge detachably mountable to a main assembly of an electrophotographic image forming apparatus for forming an image on a recording material, comprising:

(a) an electrophotographic photosensitive member (photosensitive drum 1);

(b) process means actable on said electrophotographic photosensitive member (charging roller 2, developing sleeve 3, cleaning blade 5);

(c) and end cover (development holder 12) including base (12*j*);

a gear train including a plurality of gears (toner stirring gear 13, idler gear 14, 15, 16) mounted to said base;

a first opening (opening 12*h*), provided in said base so as to be opposed to a gear (toner stirring gear 13) of said gear train, for permitting the gear of said gear train to be rotated externally when said end cover is mounted to a cartridge frame (toner frame 32*a*, developing frame 32*b*) in assembling of said process cartridge;

a second opening (through-hole 12*e*), provided opposed to said cartridge gear, for permitting observation of rotation of the cartridge gear provided in the cartridge frame which cartridge gear (development stirring gear 10) receives driving force through said gear train when the gear opposed to said first opening is rotated.

Said process means includes a developing roller (developing sleeve 3) and a toner feeding member (development stirring device 8) for feeding toner accommodated in a developer chamber in which said developing roller is provided and which is used to develop a latent image formed on the electrophotographic photosensitive member, wherein said gear train receives rotation driving force for a developing roller gear (sleeve gear 13) provided at one end of said developing roller, and the rotation driving force is transmitted to said-toner feeding member.

There is further provided:

An assembling method for a process cartridge including an electrophotographic photosensitive member, process means (charging roller 2, developing sleeve 3, cleaning blade 5) actable on said electrophotographic photosensitive member (photosensitive drum 1), said method comprising:

(a) preparing a developing roller (developing sleeve 3) mounted to a cartridge frame (toner frame 32*a*, developing frame 32*b*) and having a developing roller gear (sleeve gear 17) at one end;

(b) preparing a toner feeding member (toner stirring gear 13) for feeding the toner accommodated in a developer chamber in which a developing roller is provided and to which a gear of the toner feeding member (development stirring device 8) is mounted at one end thereof;

(c) and end cover (development holder 12) including base (12*j*);

a gear train (toner stirring gear 13, idler gears 14, 15, 16) including a plurality of gears (toner stirring gear 13, idler gears 14, 15, 16) mounted on said base;

a first opening (opening 12*h*), provided in said base so as to be opposed to a gear (toner stirring gear 13) of said gear train, for permitting the gear of said gear train to be rotated externally when said end cover (development holder 12) is mounted to a cartridge frame (toner frame 32*a*, developing frame 32*b*) in assembling of said process cartridge;

a second opening (through-hole 12*e*), provided opposed to said cartridge gear (development stirring gear 10), for permitting observation of rotation of the cartridge gear provided in the cartridge frame which cartridge gear receives driving force through said gear train when the gear opposed to said first opening is rotated;

mounting said end cover to a cartridge frame, while rotating one of gears constituting said gear train, inserted through first opening to rotate all the gears.

Phases of a gear of said gear train, a developing roller gear provided at one side of a developing roller (sleeve gear 17), a gear (idler gear 14, 16) of the toner feeding member provided at one end of a toner feeding member (development stirring gear 10), are matched by mounting said end cover to the cartridge frame while rotating said gear train.

According to the embodiments, a driving member such as a gear and the stirring device can be engaged and assembled at a regular position (with correct phase). The inspection of the gear mounting and the inspection of the operation can be easily carried out by observing rotation of a final follow member, the projection therein or the flat portion of the peripheral surface thereof. The mounting is carried out onto the cartridge frame, while rotating the gear supported on the frame by an external gear. The cartridge frame is provided with a gear engaged with the frame, the gears can be assembled without wearing or damage to the gears. Thus, the assembling property is improved, and the check operation after the assembling can be easily carried out. The features of the present invention is not limited to manual or automatic assembling operation, so that the same parts are usable for the automatic assembling and manual assembling.

According to this embodiment, the same components can be used for both manual and automated assembly of a process cartridge. Also, assembly quality can be improved; assembly problems such as biting among gears can be eliminated. Further, even after a process cartridge is assembled, a process cartridge can be easily tested for assembly errors, in particular, the errors made while attaching the gears of the driving section, and the errors in the gear operation. Thus, productivity can be improved without excessive cost increase; according to the present invention, efficiency is improved in assembling a process cartridge.

While the invention has been described with reference to the structures disclosed herein, it is not confined to the details set forth, and this application is intended to cover such modifications or changes as may come within the purposes of the improvements or the scope of the following claims.

What is claimed is:

1. An end cover for a process cartridge detachably mountable to an electrophotographic image forming apparatus for forming an image on a recording material, said end cover comprising:

a base;

a gear train including a plurality of gears mounted on said base;

a first opening, provided in said base so as to be opposed to a gear of said gear train, for permitting the gear of said gear train to be rotated externally when said end cover is mounted to a cartridge frame in assembling of said process cartridge; and a second opening, provided in said base so as to be opposed to a cartridge gear, for permitting observation of rotation of the cartridge gear provided in the cartridge frame, when said end cover is mounted to a cartridge frame in assembling of said process cartridge, said cartridge gear receiving a driving force through said gear train when the gear opposed to said first opening is rotated.

2. An end cover according to claim 1, wherein said gear train receives rotation driving force from a developing roller gear provided at one end of a developing roller contained in said process cartridge, and transmits the rotation driving force to a toner feeding member for feeding the toner in a developer chamber provided with a developing roller contained in said process cartridge.

3. An end cover according to claim 2, wherein said cartridge gear is a gear of the toner feeding member provided at one end of said toner feeding member, wherein said gear of the toner feeding member is provided with a rib at a side faced to said second opening, and wherein said rib can be observed from outside of said end cover through said second opening.

4. An end cover according to claim 3, wherein said rib is effective to match phase between said gear of the toner feeding member and said toner feeding member when they are connected.

5. An end cover according to claim 2, wherein said cartridge gear is a gear of the toner feeding member provided at one end of said toner feeding member, wherein said gear of the toner feeding member is provided with a cut-away portion at a side faced to said second opening, and wherein said cut-away portion can be observed from outside of said end cover through said second opening.

6. An end cover according to claim 5, wherein, said cut-away portion is effective to match phase between said gear of the toner feeding member and said toner feeding member when they are connnected.

7. An end cover according to claim 1, wherein when said end cover is mounted to a cartridge frame in assembling said process cartridge, a gear is inserted through said first opening and is engaged with the gear opposed to said first opening, and said gear train is rotated.

8. An end cover according to claim 7, wherein phases are matched between a gear of said gear train, said developing roller gear and said gear of the toner feeding member by rotation of said gear train.

9. A process cartridge which is detachably mountable to a main assembly of an electrophotographic image forming apparatus for forming an image on a recording material, said process cartridge comprising:

(a) an electrophotographic photosensitive member:

(b) process means actable on said electrophotographic photosensitive member; and (c) an end cover including;

a base;

a gear train including a plurality of gears mounted on said base;

a first opening, provided in said base so as to be opposed to a gear of said gear train, for permitting the gear of said gear train to be rotated externally when said end cover is mounted to a cartridge frame in assembling of said process cartridge; and a second opening, provided opposed in said base so as to be opposed to a cartridge gear, for permitting observation of rotation of the cartridge gear provided in the cartridge frame, when said end cover is mounted to a cartridge frame in assembling of said process cartridge, said cartridge gear receiving a driving force through said gear train when the gear opposed to said first opening is rotated.

10. A process cartridge according to claim 9, wherein said process means includes a developing roller and a toner feeding member for feeding toner accommodated in a developer chamber in which said developing roller is provided and which is used to develop a latent image formed on the electrophotographic photosensitive member, wherein said gear train receives a rotation driving force for a developing roller gear provided at one end of said developing roller, and the rotation driving force is transmitted to said toner feeding member.

11. A process cartridge according to claim 10, wherein said cartridge gear is a gear of the toner feeding member provided at one end of said toner feeding member, wherein said gear of the toner feeding member is provided with a rib at a side faced to said second opening, and wherein said rib can be observed from outside of said end cover through said second opening.

12. A process cartridge according to claim 11, wherein said rib is effective to match phase between said gear of the toner feeding member and said toner feeding member when they are connected.

13. A process cartridge according to claim 10, wherein said cartridge gear is a gear of the toner feeding member provided at one end of said toner feeding member, wherein said gear of the toner feeding member is provided with a cut-away portion at a side faced to said second opening, and wherein said cut-away portion can be observed from outside of said end cover through said second opening.

14. A process cartridge according to claim 13, wherein said cut-away portion is effective to match phase between said gear of the toner feeding member and said toner feeding member when they are connected.

15. A process cartridge according to claim 9, wherein when said end cover is mounted to a cartridge frame in assembling said process cartridge, the gear is inserted through said first opening and is engaged with a gear opposed to said first opening, and said gear train is rotated.

16. A process cartridge according to claim 15, wherein phases are matched between a gear of said gear train, said developing roller gear and said gear of the toner feeding member by rotation of said gear train.

17. An assembling method for a process cartridge including an electrophotographic photosensitive member, a developing roller for developing a latent image formed on said electrophotographic photosensitive member, said method comprising:

(a) preparing a developing roller mounted to a cartridge frame and having a developing roller gear at one end;

(b) preparing a toner feeding member for feeding the toner accommodated in a developer chamber in which a developing roller is provided and to which a gear of the toner feeding member is mounted at one end thereof;

(c) preparing an end cover including:

a base;

a gear train including a plurality of gears mounted on said base;

a first opening, provided in said base so as to be opposed to a gear of said gear train, for permitting the gear of said gear train to be rotated externally when said end cover is mounted to a cartridge frame in assembling of said process cartridge;

a second opening, provided in said base so as to be opposed to a cartridge gear, for permitting observation of rotation of the cartridge gear provided in the cartridge frame, when said end cover is mounted to a cartridge frame in assembling of said process cartridge, said cartridge gear receiving a driving force through said gear train when the gear opposed to said first opening is rotated; and (d) mounting said end cover to a cartridge frame, while rotating one of the gears constituting said gear train, inserted through said first opening to rotate all the gears.

18. A method according to claim 17, wherein phases of a gear of said gear train, a developing roller gear provided at one side of a developing roller, a gear of the toner feeding member provided at one end of a toner feeding member, are matched by mounting said end cover to the cartridge frame while rotating said gear train.

19. An end cover for a process cartridge detachably mountable to an electrophotographic image forming apparatus for forming an image on a recording material, said end cover comprising:

a base;

a gear train including a plurality of gears mounted on said base;

a first opening, provided in said base so as to be opposed to a gear of said gear train, for permitting the gear of said gear train to be rotated externally when said end cover is mounted to a cartridge frame in assembling of said process cartridge;

a second opening, provided in said base so as to be opposed to a cartridge gear, for permitting observation of rotation of the cartridge gear provided in the cartridge frame, when said end cover is mounted to a cartridge frame in assembling of said process cartridge, said cartridge gear receiving a driving force through said gear train when the gear opposed to said first opening is rotated, wherein said gear train receives a rotation driving force from a developing roller gear provided at one end of a developing roller contained in said process cartridge, and transmits the rotation driving force to a toner feeding member for feeding the toner in a developer chamber provided with a developing roller contained in said process cartridge, wherein said cartridge gear is a gear of the toner feeding member provided at one end of said toner feeding member, wherein said gear of the toner feeding member is provided with a rib at a side faced to said second opening, and wherein said rib can be observed from outside of said end cover through said second opening, wherein said gear of the toner feeding member is provided with a cut-away portion at a side faced to said second opening, and wherein said cut-away portion can be observed from outside of said end cover through said second opening.

20. An end cover according to claim 19, wherein said rib is effective to match phase between said gear of the toner feeding member and said toner feeding member when they are connected.

21. An end cover according to claim 19, wherein said cut-away portion is effective to match phase between said gear of the toner feeding member and said toner feeding member when they are connected.

22. A process cartridge which is detachably mountable to a main assembly of an electrophotographic image forming apparatus for forming an image on a recording material, said process cartridge comprising:

(a) an electrophotographic photosensitive member:

(b) process means actable on said electrophotographic photosensitive member; and (c) an end cover comprising:

a base;

a gear train including a plurality of gears mounted on said base;

a first opening, provided in said base so as to be opposed to a gear of said gear train, for permitting the gear of said gear train to be rotated externally when said end cover is mounted to a cartridge frame in assembling of said process cartridge; and a second opening, provided in said base so as to be opposed to a cartridge gear, for permitting observation of rotation of the cartridge gear provided in the cartridge frame, when said end cover is mounted to a cartridge frame in assembling of said process cartridge, said cartridge gear receiving a driving force through said gear train when the gear opposed to said first opening is rotated, wherein said gear train receives a rotation driving force from a developing roller gear provided at one end of a developing roller contained in said process cartridge, and transmits the rotation driving force to a toner feeding member for feeding the toner in a developer chamber provided with a developing roller contained in said process cartridge, wherein said cartridge gear is a gear of the toner feeding member provided at one end of said toner feeding member, wherein said gear of the toner feeding member is provided with a rib at a side faced to said second opening, and wherein said rib can be observed from outside of said end cover through said second opening, wherein said gear of the toner feeding member is provided with a cut-away portion at a side faced to said second opening, and wherein said cut-away portion can be observed from outside of said end cover through said second opening.

23. A process cartridge according to claim 22, wherein said gear train receives a rotation driving force for a developing roller gear provided at one end of said developing roller, and the rotation driving force is transmitted to said toner feeding member.

24. An assembling method for a process cartridge including an electrophotographic photosensitive member, a developing roller for developing a latent image formed on said electrophotographic photosensitive member, said method comprising:

(a) preparing a developing roller mounted to a cartridge frame and having a developing roller gear at one end;

(b) preparing a toner feeding member for feeding the toner accommodated in a developer chamber in which a developing roller is provided and to which a gear of the toner feeding member is mounted at one end thereof;

(c) preparing an end cover including:

a base;

a gear train including a plurality of gears mounted on said base;

a first opening, provided in said base so as to be opposed to a gear of said gear train, for permitting the gear of said gear train to be rotated externally when said end cover is mounted to a cartridge frame in assembling of said process cartridge; and a second opening, provided in said base so as to be opposed to a cartridge gear, for permitting observation of rotation of the cartridge gear provided in the cartridge frame, when said end cover is mounted to a cartridge frame in assembling of said process cartridge, said cartridge gear receiving a driving force through said gear train when the gear opposed to said first opening is rotated, wherein said gear train receives a rotation driving force from a developing roller gear provided at one end of a developing roller contained in said process cartridge, and transmits the rotation driving force to a toner feeding member for feeding the toner in a developer chamber provided with a developing roller contained in said process cartridge, wherein said cartridge gear is a gear of the toner feeding member provided at one end of said toner feeding member, wherein said gear of the toner feeding member is provided with a rib at a side faced to said second opening, and wherein said rib can be observed from outside of said end cover through said second opening, wherein said gear of the toner feeding member is provided with a cut-away portion at a side faced to said second opening, and wherein said cut-away portion can be observed from outside of said end cover through said second opening; and (d) mounting said end cover to a cartridge frame, while rotating one of the gears constituting said gear train, inserted through said first opening to rotate all the gears.

* * * * *